United States Patent [19]

Nobbe

[11] 4,348,344

[45] Sep. 7, 1982

[54] METHOD AND DEVICE FOR PRODUCING SLOTTED CONCRETE WALLS IN PLACE

[76] Inventor: Paul J. Nobbe, R.R. 2, Brookville, Ind. 47012

[21] Appl. No.: 189,090

[22] Filed: Sep. 22, 1980

[51] Int. Cl.[3] ..... E04B 1/16; B22C 9/22

[52] U.S. Cl. ..... 264/31; 52/606; 119/20; 119/28; 249/10; 249/18; 249/60; 249/64; 249/177; 249/183; 249/184; 249/193; 264/333

[58] Field of Search ..... 264/31, 71, 333; 249/60, 10, 142, 145, 148, 18, 63, 64, 193, 179, 180, 183, 184, 186, 177, 176; 52/606; 119/20, 28

[56] References Cited

U.S. PATENT DOCUMENTS

| | | | |
|---|---|---|---|
| 877,874 | 1/1908 | Tsanoff | 249/142 X |
| 1,233,847 | 7/1917 | Cornuelle | 264/157 |
| 1,338,468 | 4/1920 | Tsanoff | 249/145 X |
| 3,265,349 | 8/1966 | Hamrick | 249/177 |
| 3,318,563 | 5/1967 | Downing | 249/176 X |
| 3,441,242 | 4/1969 | Schonauer | 249/177 X |
| 3,488,027 | 1/1970 | Evans | 249/176 X |
| 3,626,904 | 12/1971 | Hattern | 119/28 |
| 3,656,729 | 4/1972 | Borgert | 249/18 |
| 3,731,448 | 5/1973 | Leo | 52/606 X |
| 3,799,490 | 3/1974 | Bunger | 249/177 X |
| 3,829,057 | 8/1974 | Fuchs | 249/183 X |
| 4,119,691 | 10/1978 | Nobbe | 249/60 X |
| 4,168,820 | 9/1979 | Nobbe | 249/142 |

FOREIGN PATENT DOCUMENTS

| | | | |
|---|---|---|---|
| 128119 | 7/1948 | Australia | 52/606 |
| 2739163 | 3/1979 | Fed. Rep. of Germany | 119/28 |
| 2755539 | 6/1979 | Fed. Rep. of Germany | 119/28 |

*Primary Examiner*—Philip Anderson

*Attorney, Agent, or Firm*—Woodard, Weikart, Emhardt & Naughton

[57] ABSTRACT

A method and device for producing a slotted concrete vertical wall. A pair of vertically extending forms having vertically extending ridges are positioned on the final use site of the slotted wall. The ridges of one mold are positioned adjacent and aligned with the ridges of the second mold. A pair of forms are located outwardly and adjacent the molds with a plurality of ties extending through the ridges of the molds being secured to the forms connecting the molds and forms together as concrete is poured between and around the ridges. The forms and molds are removed once the concrete is solidified leaving the slotted concrete wall permanently in the position poured.

10 Claims, 6 Drawing Figures

METHOD AND DEVICE FOR PRODUCING SLOTTED CONCRETE WALLS IN PLACE

BACKGROUND OF THE INVENTION

This invention is in the field of construction and more specifically, the construction of concrete walls used in housing animals. The use of concrete slabs in parallel spaced relationship forming a slotted floor to support animals is well known. Such a floor is disclosed, for example, in my U.S. Pat. Nos. 4,119,691 and 4,168,820. The floors may be precast at a production facility and then transported to the use site or may be poured on the use site thereby saving the transportation costs encountered in the former method. The vertical walls of the animal enclosure may be poured on site using conventional concrete forms. In the event vertically extending ventilation slots are desired in the side walls, then it is necessary to produce the walls at a separate production facility utilizing expensive and hard-to-transport molds. Heretofore, such slotted side walls have either been precast and transported to the use site or metal fence-like walls have been utilized. Disclosed herein is a thin-walled lightweight mold to be used with conventional concrete forms for producing a vertically standing slotted concrete wall poured at the use site in final position. The molds may be used with additional pairs of forms to integrally connect the slotted concrete wall with an unslotted concrete wall.

SUMMARY OF THE INVENTION

One embodiment of the present invention is a device for forming a vertical concrete wall poured in place comprising a pair of mutually facing and aligned molds each having a preformed main body of thin-walled construction, each main body having a plurality of parallel vertically extending hollow ridges, the ridges of one of the molds being aligned and in contact with the ridges of the other of the molds, the ridges including aligned passages extending therethrough, a first pair of spaced-apart forms between which are located the molds, and a plurality of ties extending through the passages of the ridges and connected to the forms removably securing the forms and molds together as concrete is poured between the molds.

Another embodiment of the present invention is a method of producing a slotted vertical wall on site in a building for livestock comprising the steps of positioning on the final use site for the wall a pair of mutually facing and aligned molds having vertically extending hollow ridges, locating the ridges of one of the molds against and aligned with ridges of the other of the molds to insure absence of concrete directly between ridges of one mold and ridges of the other mold forming slotted openings in the concrete wall to be formed, locating a first pair of forms on opposite sides of the molds, extending a plurality of ties through the ridges of the molds, attaching the ties to the forms, securing the forms and molds together, pouring concrete between the molds forming a slotted concrete wall, removing the forms and molds once the concrete has solidified, and leaving the concrete as solidified permanently in the vertical position poured and formed.

It is an object of the present invention to provide a new and improved device for forming a concrete wall with ventilation slots poured at the use site in final position.

It is a further object of the present invention to provide a new and improved method of producing a slotted concrete wall on the use site in final position.

Related objects and advantages of the present invention will be apparent from the following description.

DESCRIPTION OF THE PREFERRED EMBODIMENTS

Figure 1:
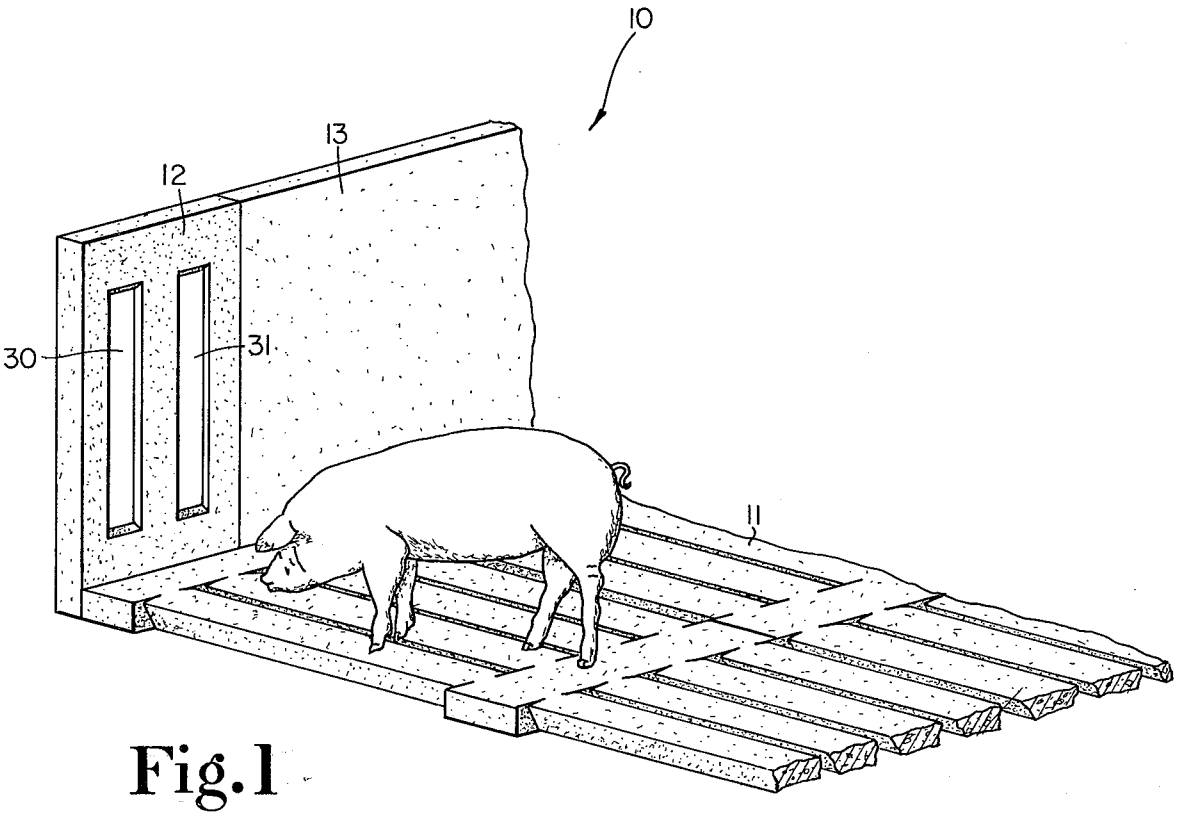
FIG. 1 is a fragmentary perspective view of an animal enclosure showing the slotted concrete wall produced with the device and method disclosed herein.

For the purposes of promoting an understanding of the principles of the invention, reference will now be made to the embodiments illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring now more particularly to FIG. 1, there is shown a fragmentary view of an enclosure or pen 10 for enclosing animals such as pigs. The enclosure includes a concrete slotted floor 11 surrounded by a plurality of concrete walls including slotted concrete wall 12 and a solid or unslotted concrete wall 13. The device for forming concrete slotted wall 12 is shown in FIGS. 2–5.

Figure 4:
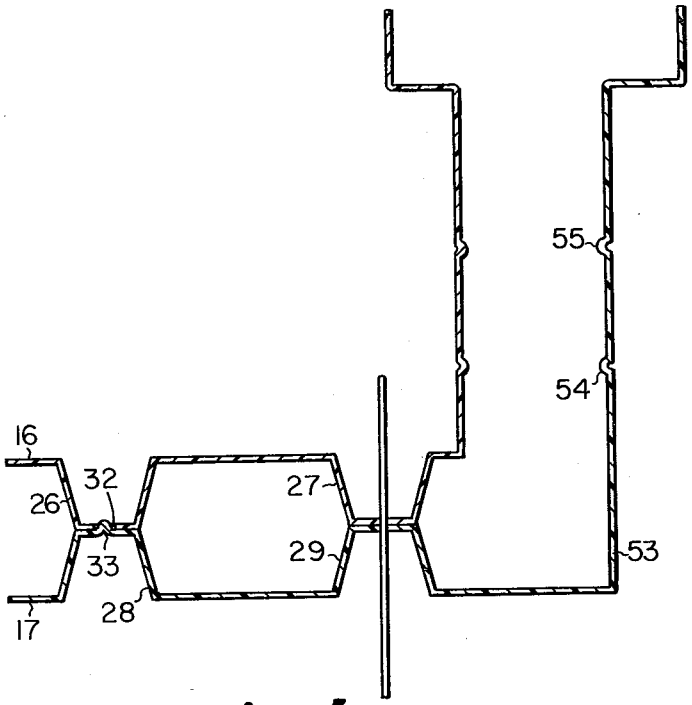
FIG. 4 is an enlarged cross-sectional view taken along the line 4—4 of FIG. 3 and viewed in the direction of the arrows.
Figure 3:
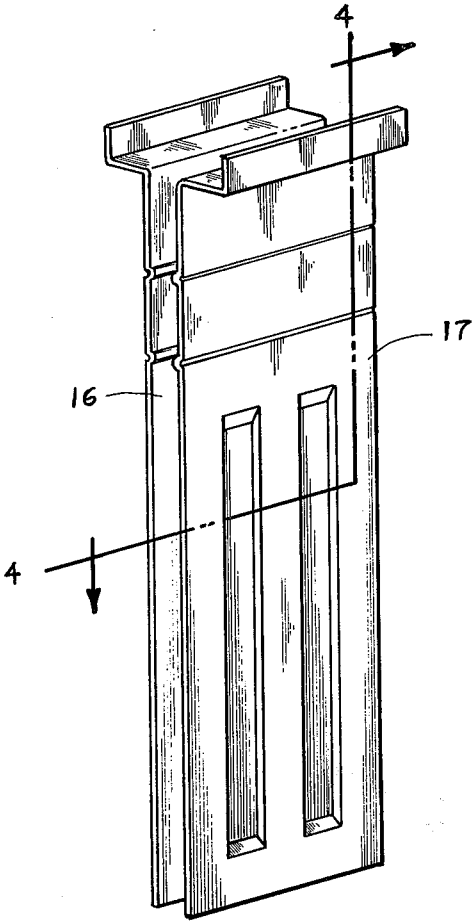
FIG. 3 is a reduced perspective view of the pair of molds shown in FIG. 2.

The device 15 (FIG. 2) for forming the concrete walls 12 and 13 includes a pair of mutually facing and aligned molds 16 and 17 positioned between and secured to a first pair of spaced apart conventional forms 18 and 19 in turn aligned with conventional forms 75 and 76. Molds 16 and 17 are shown removed from forms 18 and 19 in FIG. 3 with FIG. 4 showing a cross-sectional view of the molds.

Molds 16 and 17 each have a preformed main body of thin-walled construction. The molds may be produced by vacuum forming a sheet of plastic over a master mold. For example, vacuum forming device 20, shown schematically in FIG. 6, has a main frame 21 in which a wooden, or other suitable material, master mold 22 is mounted. Master mold 22 includes a main body with a plurality of longitudinally extending ridges 23 spaced apart and surrounded by flat portions 24. A sheet of plastic is drawn over mold 22 by the application of vacuum via passages 25 to the sheet.

Each mold 16 and 17 has a main body with a plurality of parallel and vertically extending hollow ridges. For example, mold 16 (FIG. 2) includes respectively ridges 26 and 27 aligned across and in contact with ridges 28 and 29 of mold 17. The ridges on molds 16 and 17 cooperate to form the parallel and longitudinally extending slots 30 and 31 extending completely through wall 12 (FIG. 1).

Means for aligning the ridges on molds 16 and 17 are provided by molding a plurality of tits on each ridge. A plurality of projections 30 extend outwardly from the top surface of ridges 23 on master mold 22 thereby forming a thin-walled projection or tit 31 on sheet 16. The tits may then be knocked out or removed from one of the molds forming passages which receive the tits of the adjacent mold. For example, the tit formed on ridge 26 (FIG. 4) has been removed forming a passage 32 into which tit 33 of mold 17 projects thereby automatically aligning ridges 26 and 28.

Figure 2:
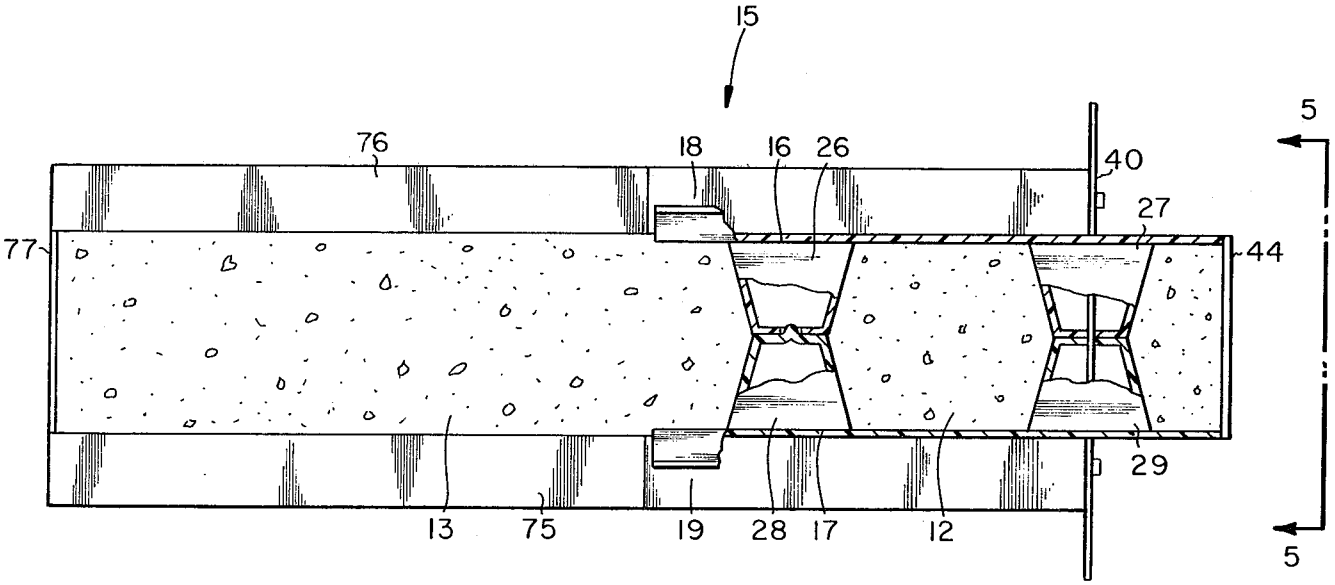
FIG. 2 is an enlarged top view of the molds and forms used to produce the concrete wall shown in FIG. 1.
Figure 6:
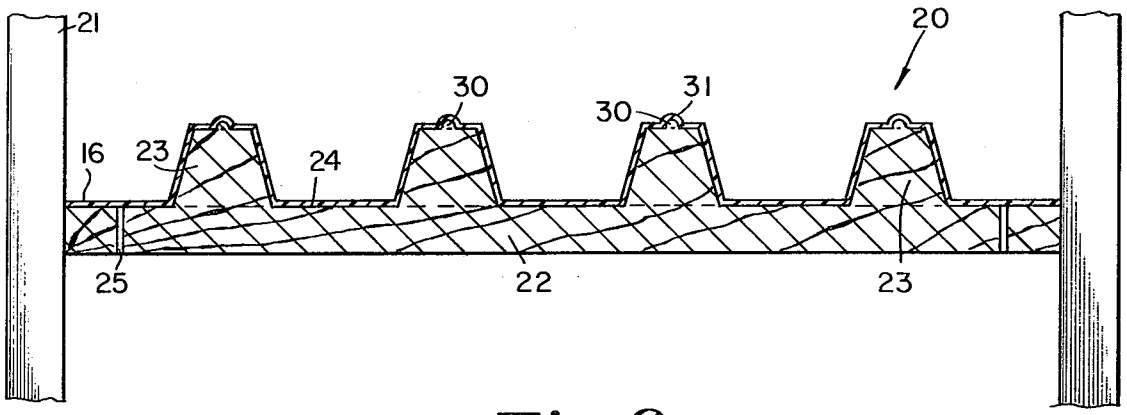
FIG. 6 is a simplified cross-sectional view of the vacuum forming device used to produce one of the molds shown in FIG. 3.
Figure 5:
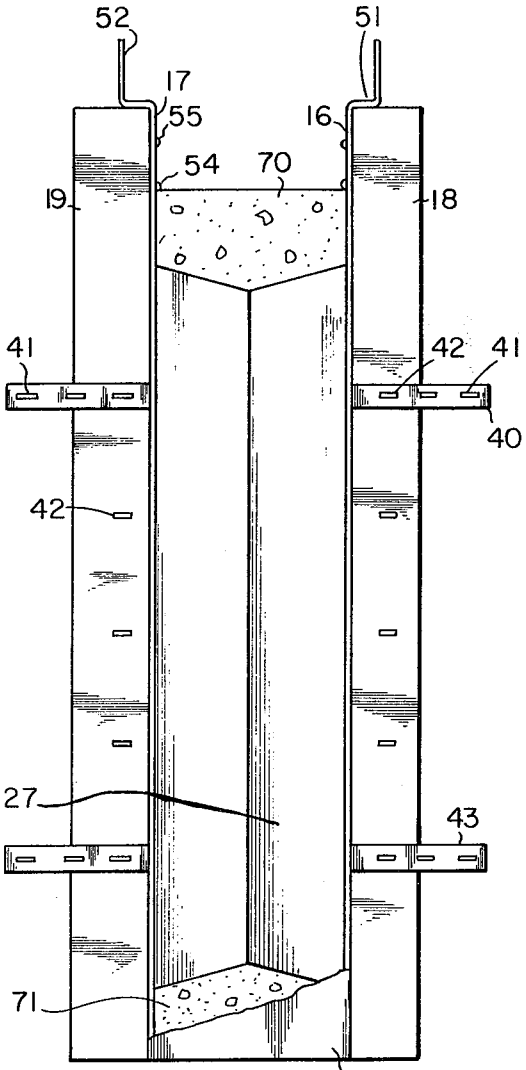
FIG. 5 is an end view of the molds and forms shown in FIG. 2 looking in the direction of arrows 5—5.

A plurality of ties or straps extend through some of the ridges on molds 16 and 17 and are connected to forms 18 and 19 thereby removably securing the forms and molds together as the concrete is poured between the molds. Ridges 26 and 28 are shown fragmented in FIG. 2 to illustrate the alignment means for securing the ridges together. Further, ridges 27 and 29 are fragmented to illustrate a tie or metal strap 40 extending through the aligned passages of ridges 27 and 29 with the aligned passages formed by the removal of tits 31 from each ridge. The opposite ends of strap 40 include a plurality of apertures 41 (FIG. 5) into which lock tabs 42 provided on the ends of forms 18 and 19 removably and lockingly extend. A second metal strap 43 is shown securing the forms and molds together at their lower ends with strap 43 also extending through aligned passages provided in ridges 27 and 29. FIGS. 2 and 4 show a pair of molds for forming a concrete wall having two vertically extending slots. It is understood that additional slots may be provided in the wall by merely adding additional ridges to the molds. For example, mold 16 is shown in FIG. 6 as having four ridges for forming four vertically extending slots in a concrete wall. Once the ridges are aligned and the forms and molds are locked together, concrete may be poured downwardly between the ridges forming wall 12. End wall 44 (FIG. 2) is secured to the adjacent ends of molds 16 and 17 by clamps or other suitable fastening means.

Molds 16 and 17 (FIG. 5) have top portions forming respectively lips 51 and 52 extending outwardly from the molds overhanging forms 18 and 19 to suspendedly support the molds relative to the forms. Lips 51 and 52 rest atop the top portion of the forms and are shown fragmented in FIG. 2.

Each mold has a top portion with a pair of spaced-apart horizontally extending indicia located above the ridges to indicate the fill level for concrete. For example, mold 17 has a top portion 53 with a pair of projections 54 and 55 extending horizontally thereacross. In the embodiment shown in FIG. 5, the concrete was filled to the level of projection 54. In the event a taller wall is desired, the concrete may be filled to the level of projection 55.

The ridges of each mold terminate between the upper and lower portions of the mold thereby allowing the concrete to flow 360° around each ridge. For example, mold 16 includes a top portion beneath which ridge 27 terminates thereby allowing the poured concrete to extend at location 70 (FIG. 5) above the ridge. Likewise, the ridge 27 terminates above the lower portion of mold 16 thereby allowing the concrete to extend at location 71 beneath the ridge. In many cases, it will be desirable to integrally connect the slotted concrete wall 12 to an adjacent post or solid concrete wall 13. Thus, a pair of conventional spaced-apart and parallel concrete forms 75 and 76 (FIG. 2) are positioned adjacent and aligned with forms 19 and 18 thereby allowing the solid concrete wall to be poured at the same time as the pouring of the slotted concrete wall. Wall 77 is secured to the ends of forms 75 and 76 thereby forming the end of solid wall 13. In certain cases, wall 13 (FIG. 2) may be standing in solid form prior to the pouring of wall 12. Thus, by extending forms 18 and 19 adjacent wall 13 so wall 13 extends between forms 18 and 19, the poured wall 12 will be joined to wall 13.

The method for producing the slotted vertically standing concrete wall 12 disclosed herein is particularly unique in that the molds and form may be positioned on the final use site and the wall poured in place without the normal precasting of the concrete wall at a remote site and then requiring the subsequent transportion of the wall to the use site. Once the pair of mutually facing and aligned molds are positioned on the final use site, the ridges of molds 16 and 17 are located adjacent and aligned with each other by means of projecting the previously discussed tits of one ridge into the apertures or openings in the adjacent ridge. Thus, by contacting adjacent ridges together, the absence of concrete directly between the ridges is insured. The forms are then located on opposite sides of the molds and a plurality of ties are extended through the ridges of the molds with the ties being attached to the forms securing the forms and molds together. Concrete is then poured between the molds to form the slotted concrete wall. Once the concrete has solidified, the forms may be removed along with the molds leaving the concrete permanently in the position poured. Additional forms may be aligned with the forms securing the molds together in the event a solid unslotted concrete wall is to be positioned adjacent and aligned with the slotted wall.

While the invention has been illustrated and described in detail in the drawings and foregoing description, the same is to be considered as illustrative and not restrictive in character, it being understood that only the preferred embodiments have been shown and described and that all changes and modifications that come within the spirit of the invention are desired to be protected.

The invention claimed is:

1. A method of producing a slotted vertical wall on site in a building for livestock comprising the steps of:

positioning on the final use site for said wall a pair of mutually facing and aligned plastic molds having vertically extending hollow ridges with horizontally extending top lips;

locating said ridges of one of said molds against and aligned with ridges of the other of said molds to insure absence of concrete directly between ridges of one mold and ridges of the other mold forming slotted openings in the concrete wall to be formed;

locating a first pair of forms on opposite sides of said molds;

hanging said molds on said forms by positioning said top lips atop said forms;

extending a plurality of ties through said ridges of said molds;

attaching said ties to said forms, securing said forms and molds together;

pouring concrete between said molds forming a slotted concrete wall;

removing said forms and molds once said concrete has solidified; and leaving said concrete as solidified permanently in the vertical position poured and formed.

2. The method of claim 1 and further comprising the steps of:

extending said forms in a horizontal direction beyond the ends of said molds over a specified distance;

pouring concrete between said forms in said specified distance and allowing same to solidify forming an unslotted solid wall integrally attached to said slotted wall.

3. The method of claim 2 wherein said aligning of said ridges of one mold with ridges of the other mold include the substep of positioning tits on said ridges of one mold into apertures on said ridges of the other mold.

4. The method of claim 3 comprising the additional step of vacuum forming said molds from plastic material prior to insertion between said forms.

5. The method of claim 2 comprising the additional step of extending said forms on opposite sides of a solid wall to be aligned with the poured wall formed between said molds.

6. A device for forming a vertical concrete wall poured in place comprising:

a pair of mutually facing and aligned molds each having a performed main body of thin-walled construction, each main body having a plurality of parallel vertically extending hollow ridges, said ridges of one of said molds being aligned and in contact with said ridges of said other of said molds, said ridges including aligned passages extending therethrough;

a first pair of spaced-apart vertical forms between which are located said molds, said molds having top portions forming lips extending outwardly therefrom overhanging and resting atop said forms to suspendedly support said molds; and a plurality of ties extending through said passages of said ridges and connected to said forms removably securing said forms and molds together as concrete is poured between said molds.

7. The device of claim 6 and further comprising alignment means on said ridges operable to align said ridges of one mold with ridges of the other mold, said alignment means including apertures on some of said ridges and tits on adjacent ridges with said tits projecting into said apertures.

8. The device of claim 6 wherein said molds each have a top portion with a pair of spaced-apart horizontally extending indicia located above said ridges indicating concrete fill levels.

9. The device of claim 6 and further comprising a second pair of spaced-apart vertical forms attached in line to said first pair of vertical forms, said second pair of forms being free of molds therebetween allowing concrete to be poured therebetween forming a solid concrete mass attached to the concrete located between said molds.

10. The device of claim 6 wherein said forms extend outwardly of and adjacent a solid concrete wall extending therebetween to be joined to the wall formed by concrete poured between said molds.

* * * * *